US011834789B2

(12) United States Patent
Ogiwara et al.

(10) Patent No.: US 11,834,789 B2
(45) Date of Patent: Dec. 5, 2023

(54) PAPERMAKING FELT AND A METHOD OF PRODUCING THE SAME

(71) Applicant: Ichikawa Co., Ltd., Tokyo (JP)

(72) Inventors: Yasuyuki Ogiwara, Tokyo (JP); Yuto Muraoka, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 38 days.

(21) Appl. No.: 17/445,615

(22) Filed: Aug. 23, 2021

(65) Prior Publication Data

US 2022/0064857 A1 Mar. 3, 2022

(30) Foreign Application Priority Data

Aug. 26, 2020 (JP) ..... 2020-142732

(51) Int. Cl.
*D21F 7/08* (2006.01)
*D21F 7/10* (2006.01)

(52) U.S. Cl.
CPC ..... *D21F 7/083* (2013.01); *D21F 7/10* (2013.01)

(58) Field of Classification Search
CPC ... D21F 7/08; D21F 7/083; D21F 7/10; D21F 7/12; D21F 1/0027; D21F 1/0036; D21F 1/0045; D21F 1/0054
USPC ..... 162/348, 358.2, 900, 904
See application file for complete search history.

(56) References Cited

U.S. PATENT DOCUMENTS 5,110,672 A * 5/1992 Zehle ..... D21F 7/10 442/271
6,797,121 B2 * 9/2004 Hyvonen ..... D21F 7/083 442/247
2006/0016571 A1 1/2006 Silakoski

FOREIGN PATENT DOCUMENTS

JP 2006-510812 A 3/2006
JP 2010-100961 A 5/2010
WO WO 2004/055265 A1 7/2004

OTHER PUBLICATIONS

Extended European Search Report dated Jan. 31, 2022 in European Patent Application No. 21192264.6, 5 pages.

* cited by examiner

*Primary Examiner* — Eric Hug
(74) *Attorney, Agent, or Firm* — Oblon, McClelland, Maier & Neustadt, L.L.P.

(57) ABSTRACT

A papermaking felt with two or more plain weave base fabrics that can be bonded to each other. The joint portions do not open when a batt fiber layer is attached or when the felt is used. The papermaking felt can be made from an MD yarn material in the felt running direction (MD direction) and a CD yarn material in the felt cross-direction (CD direction), including a combination with two or more base fabrics directly overlapped with each other, which have a joint portion wherein the MD direction end portions are joined which include a first MD direction end portion and a second MD direction end portion wherein, with regard to the base fabrics having all included joint portions. The equations (1) and (2) below are satisfied when the maximum distance in the MD direction between the joint portions of the base fabrics is x (cm) and the minimum distance thereof is y (cm): $x \leq 750$ (1); and $51 \leq y$ (2).

9 Claims, 3 Drawing Sheets

PAPERMAKING FELT AND A METHOD OF PRODUCING THE SAME

TECHNICAL FIELD

The present invention relates to a papermaking felt and to a method of producing the same.

DESCRIPTION OF THE RELATED ART

A papermaking machine for removing water from source material of paper generally comprises a wire part, a press part and a dryer part. The wire part, the press part and the dryer part are arranged in this order along the wet paper web transfer direction. The wet paper web moves in the papermaking machine in a band with a certain width in a direction (CD direction: Cross Machine Direction) perpendicular to the papermaking machine running direction (MD direction: Machine Direction). The wet paper web is transferred and squeezed while being passed from one papermaking tool to another, which are attached to the wire part, press part and dryer part, respectively, and is finally dried, in the dryer part.

The press device arranged in the press part comprises a plurality of press devices arranged in series along the wet paper web transfer direction. Each press device comprises an endless felt or an open-ended felt connected in a papermaking machine to form an endless felt, a pair of facing rolls (i.e., a roll press) arranged so as to sandwich each part of the felt, respectively, from above and below, or a roll and a cylindrical belt including a shoe (i.e., a shoe press). Water is continuously removed from the wet paper web, which is transferred by a felt running in the same direction at substantially the same speed, by pressing the wet paper web together with a felt between the pair of rolls or between a roll and a cylindrical belt including a shoe.

The functions required of a felt used in a press device include dewatering capability, smoothness, running stability and the like. The dewatering capability refers to the capability of removing water contained in the wet paper web. To achieve these functions, it is important that the felt has excellent compression recovery properties, that is, when the felt is not under pressure, there are spaces (void volume) for removing the water into the felt, and when the felt is under pressure, the maximum density of the felt is reached and the volume of these spaces is reduced to discharge the water from the felt. It is also important that the dewatering capability is maintained during the use of the felt, and that the removed water does not return to the wet paper web (prevention of rewetting).

The smoothness refers to the smoothness of the wet paper web surface and the felt surface (including the felt surface under pressure). Since the wet paper web is pressed via the felt, the surface state of the felt is transferred to the surface of the wet paper web. Therefore, to smooth the surface of the wet paper web, it is necessary to smooth the surface of the felt (including the surface of the felt under pressure).

The running stability means that the endless felt arranged in the press device runs stably without opening, breaking, skewing and meandering, and that vibrations, waviness, and the like, do not occur.

There are various types of paper, such as paper for newsprint, high-quality paper, paperboard, and household paper. There are also various types of papermaking machines that manufacture these types of paper. Currently, various types of papermaking felts are manufactured to fit these types of paper and papermaking machines, but generally, these felts are formed by integrating a batt fiber layer of a non-woven fiber material with a base fabric layer. Examples of a base fabric layer include, for example, a woven fabric made from monofilament yarn, monofilament twisted yarn, multifilament yarn or multifilament twisted yarn. This woven fabric may be a single-woven article or a multiple-woven article, or may be a laminate structure in which these are layered. Examples of this yarn include extrusions of a synthetic polymeric resin that a person skilled in the technical field of papermaking tools generally uses for this objective, such as polyamide resins and polyester resins, or animal fibers such as wool, vegetable fibers such as cotton, hemp, and the like.

Examples of the base fabric layer mentioned above include various types of woven fabric, such as a fabric woven on a weaving machine to obtain an endless shape (hollow weaving), a fabric in which the end portions of an open-ended woven fabric woven by plain weave are sewn together into an endless shape, and a fabric in which the two end portions of an open-ended woven fabric in the cross-machine direction or the machine direction are joined together to form an endless shape, Of these, a base fabric woven into an endless shape on a weaving machine (hollow weave) and a base fabric in which the end portions in the cross-machine direction of an open-ended woven fabric are joined together to form an endless shape (spiral base fabric) are referred to as endless base fabrics.

Among these, the base fabric layer (papermaking felt) manufactured by hollow weaving has excellent smoothness because it has a seamless and continuous surface. However, since each papermaking machine has different dimensions, the corresponding base fabric layers have to be completely custom manufactured. Consequently, in order to manufacture the base fabric layer by hollow weaving, it is necessary to finely change the setting of the weaving machine each time the dimensions are changed; therefore, productivity and yield are very poor.

On the other hand, as an efficient method for producing a papermaking felt, a method of joining the end portions of a plain weave base fabric in the MD direction has been proposed (Patent Document 1). Specifically, an embodiment is disclosed in which the end portions of a base fabric in the MD direction from which the transverse yarns have been removed are overlapped and pressed to attach them to each other before the batt fiber layer is attached. This Patent Document also discloses a laminate structure using the base fabric on the wet paper web-side and a hollow woven base fabric on the papermaking machine-side.

PRIOR ART DOCUMENTS

Patent Documents

Patent Document 1: JP 2006-510812

SUMMARY OF THE INVENTION

Problems to be Solved by the Invention

The papermaking felt obtained by the manufacturing method disclosed in the above prior art has very poor productivity in the case of a laminate structure using a hollow woven base fabric on the papermaking machine side because half of the base fabric used is a hollow woven base fabric.

Furthermore, in the case of a felt having a laminate structure using only a plain woven base fabric, there is a risk that the joint portion may open when the batt fiber layer is attached or while the papermaking felt is used. The opening in the present specification means that, during the attachment of the batt fiber layer or during the use of the papermaking felt, a force is applied and the joint portion opens. On the other hand, if a low tension is used so that the joint portion does not open when the batt fiber layer is attached, there is a risk that the length of one of the two or more base fabrics may be too long, and that the length of the base fabrics cannot be adjusted and the productivity may decrease because the base fabrics cannot be bonded to each other.

In the case of a felt having a laminate structure of 3 or more base fabrics, productivity can be improved by using a plain weave fabric for at least half of the base fabrics. Specifically, when 3 base fabrics are used, the productivity can be improved by using 2 or 3 plain weave base fabrics. In the case of a felt having a laminate structure of 3 or more base fabrics, an endless base fabric can be used in addition to the plain weave base fabrics. In this case, too, as with the felt having a laminate structure using only plain weave base fabrics, there is a risk that the joint portion may open when the batt fiber layer is attached or when the papermaking felt is used. Moreover, if a low tension is used so that the joint portion does not open when the batt fiber layer is attached, there is a risk that the length of the base fabrics cannot be adjusted and the productivity may decrease.

An object of the present invention is to provide a papermaking felt having a laminate structure using 2 or more plain weave base fabrics, wherein the opening of the joint portion is suppressed and which has good productivity, and a method for producing the same.

Means for Solving Said Problems

As a result of diligent studies, the present inventors have found that the problem of the present invention can be solved by setting the distance between the joint portions in the MD direction within a certain range when the batt fiber layer is attached to ensure that the strength of the joint portions of multiple plain weave fabrics is maintained until the end of the batt fiber layer installation or during the use of the papermaking felt.

(1) A papermaking felt made from an MD yarn material in the felt running direction (MD direction) and a CD yarn material in the felt cross-direction (CD direction), comprising a combination in which 2 or more base fabrics are directly overlapped with each other, which have a joint portion in which the MD direction end portions are joined which comprise a 1st MD direction end portion and a 2nd MD direction end portion wherein, with regard to the base fabrics having all included joint portions, the equations (1) and (2) hereinafter are satisfied when the maximum distance in the MD direction between the joint portions of the base fabrics is x (cm) and the minimum distance thereof is y (cm).

$$x \leq 750 \quad (1)$$

$$10 \leq y \quad (2)$$

(2) The papermaking felt according to (1) above, wherein x satisfies the equation (3) hereinafter.

$$x \leq 500 \quad (3)$$

(3) The papermaking felt according to (1) or (2) above, wherein y satisfies the equation (4) hereinafter.

$$51 \leq y \quad (4)$$

(4) The papermaking felt according to any one of (1) to (3) above, which comprises 2 base fabrics having a joint portion.

(5) The papermaking felt according to any one of (1) to (3) above, which comprises 3 or more base fabrics having a joint portion, and wherein the distances between the joint portions of the base fabric in the MD direction are not equal to each other.

(6) The papermaking felt according to any one of (1) to (5) above, which further comprises an endless base fabric.

(7) The papermaking felt according to any one of (1) to (6) above, wherein the MD-direction end portions of the base fabric having a joint portion are joined by welding.

(8) The papermaking felt according to any one of (1) to (7) above, which comprises a batt fiber layer of a non-woven fiber material.

(9) A method for producing a papermaking felt, which comprises (a) a step for overlapping each base fabric, which are made from an MD yarn material in the felt running direction (MD direction) and a CD yarn material in the felt cross-direction (CD direction), and which comprise a combination in which 2 or more base fabrics are directly overlapped with each other, which have a joint portion in which the MD direction end portions comprising a 1st MD direction end portion and a 2nd MD direction end portion are joined, (b) with regard to the base fabrics having all included joint portions, a step for arranging the base fabrics so as to satisfy the equations (1) and (2), hereinafter, when the maximum distance in the MD direction of the joint portions of the base fabrics is x (cm) and the minimum distance thereof is y (cm).

$$x \leq 750 \quad (1)$$

$$10 \leq y \quad (2)$$

(c) a step for integrating the base fabric and a batt fiber layer overlapped in the step (b).

(10) The method for producing a papermaking felt according to (9) above, which comprises a step (b) for overlapping the base fabrics so that x satisfies the equation (3) hereinafter.

$$x \leq 500 \quad (3)$$

(11) The method for producing a papermaking felt according to (9) or (10) above, which comprises a step (b) for overlapping the base fabrics so that y satisfies the equation (4) hereinafter.

$$51 \leq y \quad (4)$$

Advantages of the Invention

Due to the above constitution, it is possible to provide a papermaking felt of a laminate structure using 2 or more plain weave base fabrics, which has good productivity, and wherein the base fabrics can be bonded to each other and the joint portion does not open when the batt fiber layer is attached or when the papermaking felt is used, and a method for producing the same.

BEST MODES FOR CARRYING OUT THE INVENTION

Hereinafter, embodiments of the base fabrics for the papermaking felt according to the present invention and the method for producing the same according to the present invention will be described with reference to the drawings; however, the present invention is not limited thereto.

Furthermore, unless otherwise defined herein, all technical and scientific terms used herein have the same meaning as those commonly understood by one of ordinary skill in the art. All patents, applications and other publications (including information available on the Internet) referenced herein are hereby incorporated by reference in their entirety.

The base fabric used in the papermaking felt according to the present invention is made from an MD yarn material in the felt running direction (MD direction) and a CD yarn material in the felt cross-direction (CD direction).

Figure 1:
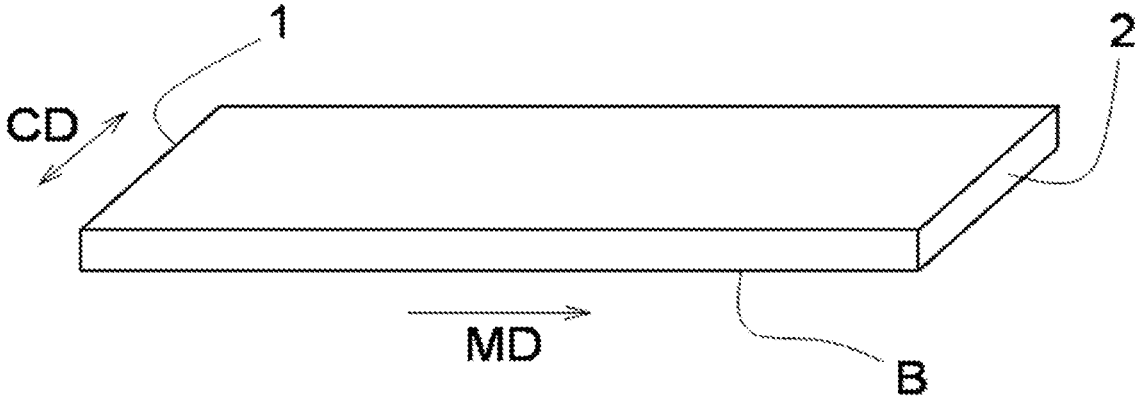
FIG. 1 is a schematic diagram of a base fabric according to the present invention.

The arrows (MD/CD) in FIG. 1 indicate the MD/CD directions of the plain weave base fabric (open-ended state). When the papermaking felt is used in a papermaking machine, the MD direction is defined as the running direction (rotational direction) of the felt, and the CD direction is defined as the direction crossing the running direction of the felt. As shown in FIG. 1, the base fabric has a 1st MD direction end portion 1 and a 2nd MD direction end portion 2.

Figure 4:
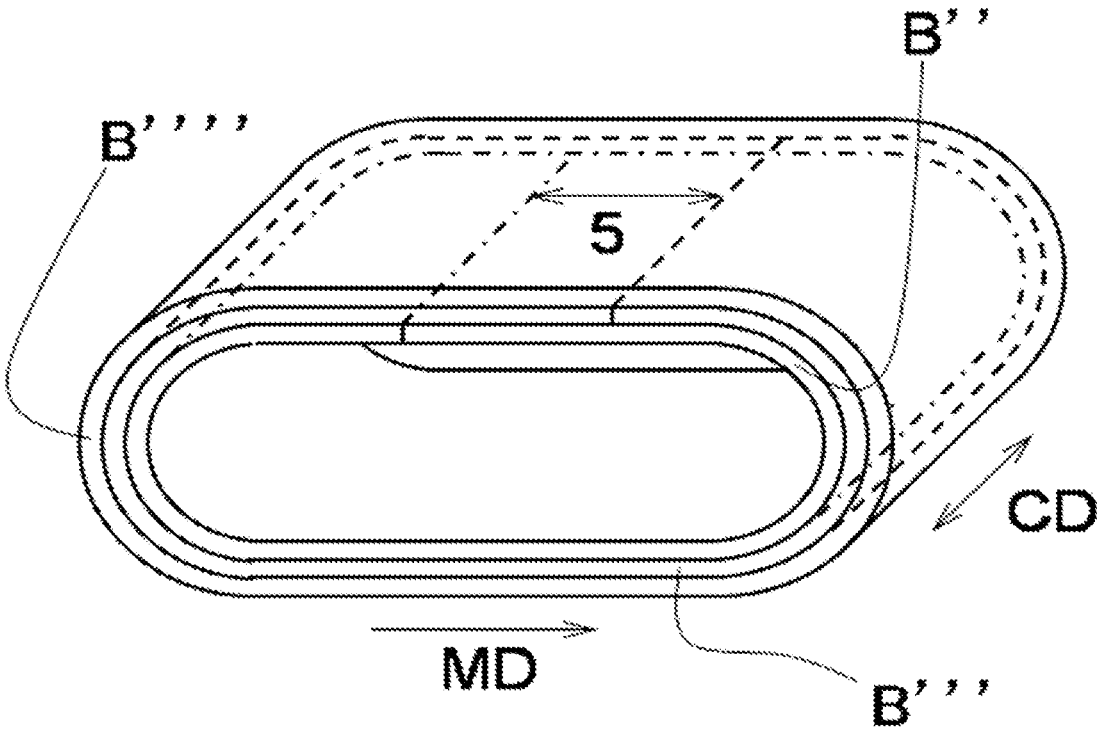
FIG. 4 is a schematic diagram of a papermaking felt formed in the production steps according to the present invention, wherein 2 base fabrics, of which the MD direction end portions are joined, and 1 endless base fabric are overlapped.

In FIG. 4, the MD/CD directions in the endless base fabric (endless state) are shown on the wet paper web-side base fabric (outermost base fabric), and are defined, as in the plain weave base fabric, as the running direction of the felt and the direction crossing the running direction.

The papermaking felt according to the present invention is a papermaking felt which is made from an MD yarn material in the felt running direction (MD direction) and a CD yarn material in the felt cross-direction (CD direction), comprising a combination in which 2 or more base fabrics having a joint portion in which the MD direction end portions are jointed and comprise a 1st MD direction end portion and a 2nd MD direction end portion (hereinafter also referred to as "base fabrics having joint portions") are directly overlapped with each other.

The papermaking felt according to the present invention is characterized in that, with regard to the base fabrics having all included joint portions, the equation (1) hereinafter is satisfied when the maximum distance in the MD direction between the joint portions of the base fabrics is x (cm).

$$x \leq 750 \quad (1)$$

A case in which x exceeds 750 is not preferred because the joint portions tend to open when the batt fiber layer is attached or the papermaking felt is used and because it becomes impossible to adjust the length of the base fabrics. In this case, the fact that the length of the base fabrics cannot be adjusted means that the length of any of the base fabrics is too long and that wrinkles are formed.

Moreover, the distance between the joint portions in the present specification refers to the minimum distance along the MD direction on the wet paper web-side base fabric, when the joint portion of each base fabric having a joint portion is moved in the vertical direction (thickness direction of the base fabric) and it is assumed that all of the joint portions are on the wet paper web-side base fabric (outermost base fabric). Furthermore, when the joint portion has a width in the MD direction, it refers to the distance between the joint portions with respect to the centre of the joint portion having the width in the MD direction.

The papermaking felt according to the present invention is characterized in that, with regard to the base fabrics having all included joint portions, the maximum distance of the joint portion in the MD direction is 750 cm or less, preferably 500 cm or less, that is, the formula (1) above, preferably the formula (3) hereinafter is satisfied.

$$x \leq 500 \quad (3)$$

The papermaking felt according to the present invention is characterized in that, with regard to the base fabrics having all included joint portions, the equation (2) hereinafter is satisfied when the minimum distance in the MD direction of the joint portion of the base fabric is y (cm).

$$10 \leq y \quad (2)$$

A case in which y is less than 10 is not preferred because there is a risk that the joint portion may open.

The papermaking felt according to the present invention is characterized in that, with regard to the base fabrics having all included joint portions, the minimum distance of the joint portion in the MD direction is 10 cm or more, preferably 51 cm or more, that is, the formula (2) above, preferably the formula (4) hereinafter is satisfied.

$$51 \leq y \quad (4)$$

In the papermaking felt according to the present invention, since the joint portion of the base fabrics having a joint portion is close to the MD direction, there is sufficient tension of the joint portion and the joint portion does not open when the batt fiber layer is attached or when the papermaking felt is used. When a batt fiber layer is attached, a tension is applied so that the base fabric which is longer than the others is tensed in the same way as the other base fabrics; however, there is a risk that the tension of the joint portion where the batt fiber layer is not attached may decrease or that the joint portion may open. However, the papermaking felt according to the present invention does not cause this problem because tension is applied after the batt fiber layer is attached to any of the joint portions close to the MD direction.

When the distance between the joint portions of the base fabrics in the MD direction is further reduced, a batt fiber layer is attached earlier to any of the joint portions, and the length of the base fabric(s) to which a batt fiber layer has not been attached is greater. Since the length of the base fabrics can be made equal in this state, the tension to be applied can be lower. This can also prevent a decrease in the tension of each joint portion and the opening of a joint portion.

As a result, it is possible to obtain a papermaking felt having good productivity and a laminated structure using 2 or more plain weave base fabrics (base fabrics that provide a base fabric with a joint portion by bonding) that can be bonded to each other, wherein the joint portions do not open when a batt fiber layer is attached or when the felt is used. Here, in the papermaking felt according to the present invention, with regard to all base fabrics used, 2 base fabrics or 3 or more base fabrics may be overlapped with each other. In the case of 2 overlapping base fabrics, only the base fabric(s) having a joint portion is/are used. Moreover, in the case of 3 or more overlapping base fabrics, only the base fabric(s) having a joint portion may be used, or an endless base fabric may be used. In the case of an endless base fabric, the papermaking felt according to the present invention comprises a base fabric having 2 or more directly overlapping joint portions.

On the other hand, if the joint portions of the base fabrics are very close together, vibration may occur during the use of the papermaking felt. To attach the batt fiber layer, the batt fiber layer is arranged on a base fabric while being layered by going back and forth in the CD direction and while the base fabric advances in the MD direction. If the overlapping pitch of the batt fiber layers and the distance between the joint portions are in the same range at this time, there is a risk that vibration may occur. In general, it is preferred that the overlapping pitch of the batt fiber layers is in the range of 8 to 50 cm.

When tension is applied, the adhesive strength (shear strength) of the batt fiber layer and the base fabric, in-between the joint portions, serves to supplement the strength of the joint portions. Therefore, it is preferable to separate the joints by a certain distance or more because the opening of the joint portions is less likely to occur. In general, the adhesive force (shear strength) of the batt fiber layer and the base fabric, in-between the joint portions, supplements the strength of the joint portions when the distance between the joint portions is 10 cm or more.

As described above, the papermaking felt according to the present invention may comprise 2, or 3 or more base fabrics having joint portions.

In the case of 3 or more base fabrics having a joint portion, in the papermaking felt according to the present invention, it is preferred that the distances between the joint portions of the base fabrics in the MD direction are not equal, because equal periods of the joint portions may cause vibrations. In the present specification, if the distances between the joint portions of the base fabrics of the papermaking felt in the MD direction are not equal to each other, it means that there is no combination in which the distances between the joint portions are equal when the distance between the joint portions is calculated for all combinations of 2 joint portions of base fabrics having 3 or more joint portions. For example, when there are 4 base fabrics having joint portions, there are 4 joint portions, and of the 5 possible combinations of 2 joint portions (when the joint portions are a, b, c, and d, respectively, the combinations are between a-b and b-c, between a-b and c-d, between a-b and b-d, between a-c and c-d, and between b-c and c-d), it is preferred that there is no combination of equal distances between the joint portions.

If the distance between the joint portions of each base fabric in the MD direction is set within a certain range, and when the number of base fabrics having joints is 3 or more, it is preferred that the distances between the joint portions are not equal, because problems of vibration and opening of the joint portions are less likely to occur.

The papermaking felt according to the present invention may have a batt fiber layer, as described above. The material constituting the batt fiber layer is not particularly limited, but it is preferred to use a non-woven fiber material.

The length of the papermaking felt according to the present invention in the MD direction is preferably 1550 cm or more and 40000 cm or less, and more preferably 2000 cm or more and 20000 cm or less. The length of the papermaking felt in the MD direction as used herein means the length of one circumference of the wet paper web-side base fabric constituting the papermaking felt along the MD direction.

By setting the length of the papermaking felt in the MD direction in such a range, the length of the base fabric to which the batt fiber layer is not attached is long when the butt fiber layer is attached, and the length of each base fabric can be made equal in this state, therefore the tension to be applied can be lower, and it is possible to prevent a decrease in the strength of the joint portions and the opening of joint portions, which is preferred.

Examples of specific embodiments of the papermaking felt according to the present invention include the following embodiments (a), (b), and (c).

(a) A papermaking felt wherein 2 base fabrics, in which a 1st MD direction end portion and a 2nd MD direction end portion are joined, are overlapped.

(b) A papermaking felt wherein 3 or more base fabrics, in which a 1st MD direction end portion and a 2nd MD direction end portion are joined, are overlapped.

(c) A papermaking felt wherein 2 or more base fabrics, in which a 1st MD direction end portion and a 2nd MD direction end portion are joined, are directly overlapped, and wherein an endless base fabric is further overlapped.

Figure 2:
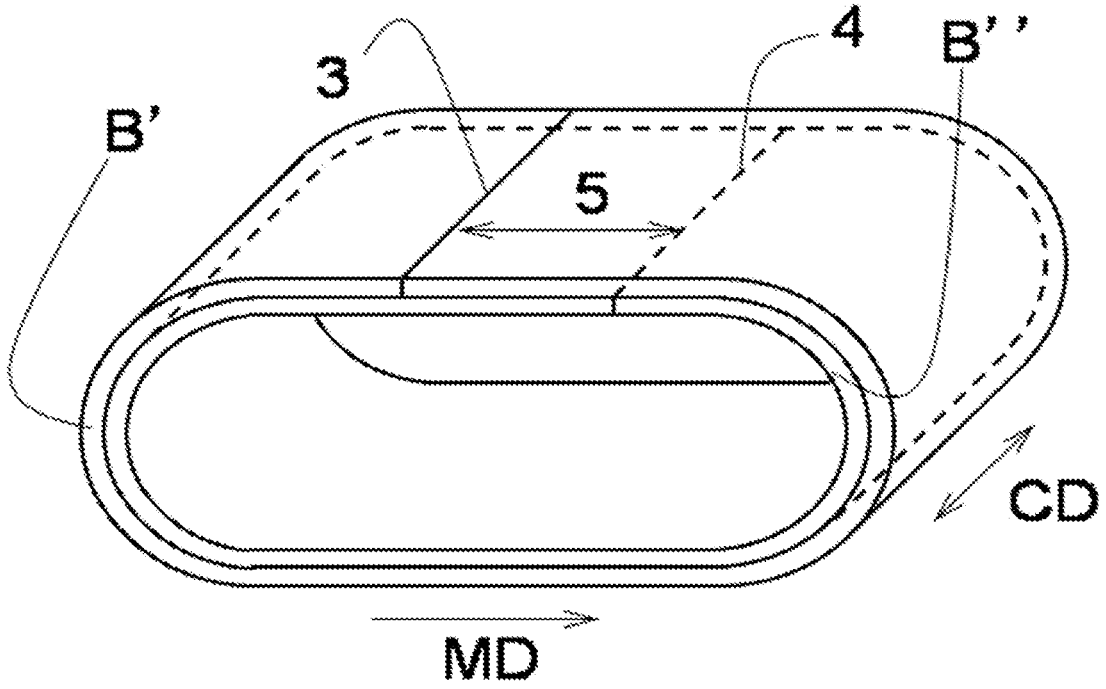
FIG. 2 is a schematic diagram of a papermaking felt formed in the production steps according to the present invention, wherein 2 base fabrics, of which the MD direction end portions are joined, are overlapped.

When a papermaking felt is produced by overlapping 2 base fabrics having a joint portion, for example, as shown in FIG. 2, the joint portion of the base fabric B' and the joint portion of the base fabric B" can be overlapped at a distance from each other in the MD direction. The distance between the joint portions can be considered as the close (small) side and the opposite far (large) side thereof. In the papermaking felt according to the present invention, the close (small) side of the distance is defined as the distance between the joint portions. For example, when the maximum distance in the MD direction of the joint portions is 750 cm or less, the close distance side may be 750 cm or less. In the case of two base fabrics, the distance 5 is the maximum distance x and also the minimum distance y.

Figure 3:
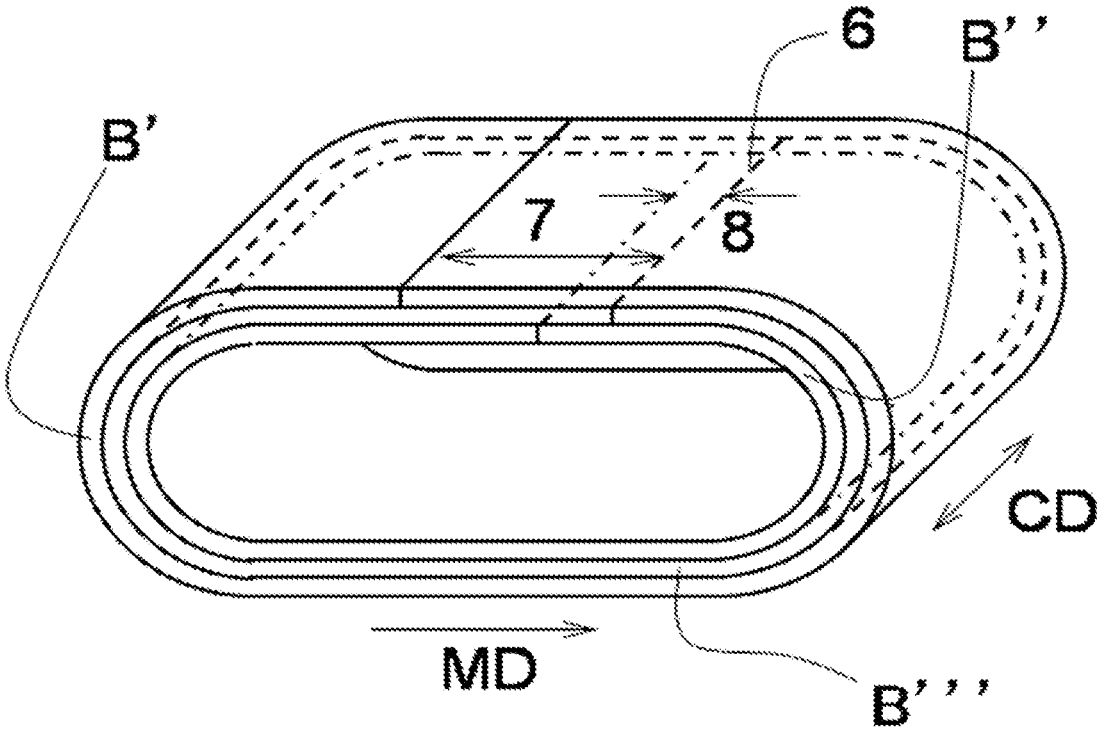
FIG. 3 is a schematic diagram of a papermaking felt formed in the production steps according to the present invention, wherein 3 base fabrics, of which the MD direction end portions are joined, are overlapped.

When a papermaking felt is produced by overlapping 3 or more base fabrics having a joint portion, for example, as shown in FIG. 3, the joint portions of the three base fabrics B', B", B'" can be overlapped at a distance from each other in the MD direction. As with 2 base fabrics, 3 joint portions are arranged within 750 cm, and the distance between the joint portions most distant in the MD direction is the maximum distance x (cm). In the case of FIG. 3, the distance 6 between the joint portion of the wet paper web-side base fabric and the joint portion of the base fabric between the wet paper web side-base fabric and the papermaking machine-side base fabric (the innermost base fabric) is the maximum distance x, and the distance 7 between joint portion of the papermaking machine-side base fabric and the joint portion of the base fabric between the wet paper web-side base fabric and the papermaking machine-side base fabric is the minimum distance y. Here, the distance 6 is larger than the distance between the joint portion of the wet paper web-side base fabric and the joint portion of the papermaking machine-side base fabric, while, the distance 7 is smaller than the distance between the joint portion of the wet paper web-side base fabric and the papermaking machine-side base fabric.

When a papermaking felt is produced by overlapping 2 or more base fabrics having a joint portion and an endless base fabric, for example, as shown in FIG. 4, it is possible to directly overlap the papermaking machine-side base fabric and the base fabric between the wet paper web-side base fabric and the papermaking machine-side base fabric, and to further overlap a hollow weave base fabric as wet paper web-side base fabric. 2 base fabrics having a joint portion can be overlapped with a distance between the joint portion of base fabric B" and the joint portion of base fabric B'" in the MD direction. In this case too, as in the case of producing a papermaking felt by overlapping 2 base fabrics, the close (small) side of the distance is defined as the distance between the joint portions, and distance 5 is the maximum distance x and also the minimum distance y.

In a felt having a laminated structure of 3 or more base fabrics, regarding the position of the base fabrics when manufacturing a papermaking felt by overlapping base fabrics having 2 or more joint portions and an endless base fabric, it is sufficient that at least 2 or more base fabrics having a joint portion are directly overlapped with each other, endless base fabrics and other base fabrics having a joint portion may be in any position.

Moreover, in case there is a set of 2 or more base fabrics with directly overlapping joint portions and 1 base fabric having a joint portion with an overlapping non-adjacent joint portion, with regard to all base fabrics having a joint portion, the distance between the joint portions in the MD direction may be set within the range in which the equations (1) and (2) are satisfied. In the same way, in case there are 2 or more sets of 2 or more base fabrics having directly overlapping joint portions, which overlap with each other, with regard to all base fabrics having a joint portion, the distance between the joint portions in the MD direction may be set within the range in which the equations (1) and (2) are satisfied. For example, in the case of a felt having a laminated structure of 5 base fabrics, in which 2 base fabrics having a joint portion, an endless base fabric, and 2 base fabrics having a joint portion are overlapped in this order, and in which the maximum distance between the joint portions in the MD direction is 750 cm or less, the 4 joint portions may all be arranged within 750 cm or less.

In the same way, in case there are/is (an) overlapping base fabric(s) having a joint portion in addition to the 2 or more directly overlapping base fabrics having a joint portion, with regard to all base fabrics having a joint portion, the distance between the joint portions in the MD direction may be set within the range in which the equations (1) and (2) are satisfied.

The MD-direction end portions of the base fabrics having a joint portion can be joined by sewing, suture, adhesive, needling, melting, welding, or the like. Of these, from the viewpoint of ease of operation and the like, joining is preferably performed by welding.

Moreover, the joining method may be the same or different for each of a plurality of base fabrics.

With regard to all the base fabrics used for the papermaking felt according to the present invention, thermoplastic resins are preferred as the constituent materials of the fibers constituting the MD yarn material and the CD yarn material of the base fabric. For example, polyethylene resin, polypropylene resin, polystyrene resin, acrylic resin, polyethylene terephthalate resin, polyamide resin, acetal resin, polycarbonate resin and the like can be used, but polyamide resin is particularly preferred. Furthermore, the constituent materials of the MD thread material and the CD thread material may be the same or different.

Examples of the fibers constituting the MD yarn material and CD yarn material include monofilaments, multifilaments, spun yarn, and processed yarn such as texture yarn, bulky yarn, stretch yarn, and the like, made by crimping, bulky processing, and the like; these yarns can be further twisted into a twisted yarn. The cross-sectional shape of the fiber can be circular, roughly elliptical, polygonal, roughly star-shaped, roughly rectangular, or the like.

The fineness of the fibers constituting the MD yarn material and the CD yarn material is not particularly limited, but in the case of a monofilament, it is preferably 89 to 2240 dtex (0.10 to 0.50 mm), and more preferably 200 to 1440 dtex (0.15 to 0.40 mm).

With regard to all the base fabrics used in the papermaking felt according to the present invention, the MD yarn material and the CD yarn material constituting the base fabric may be of one type only, or may be of 2 or more types.

The base fabric may either have a single-weave structure or a multi-weave structure; the weave structure is also not particularly limited, for example, other structures such as plain weave, twill weave, satin weave, and weird weave, and any combination thereof may be used. Moreover, the fabric is not limited to woven fabrics, and it is also possible to use a lattice-like material in which the ground warp yarns and the ground weft yarns are arranged one above the other.

With regard to all the base fabrics used in the papermaking felts according to the present invention, the basis weight is not particularly limited, but can usually be 100 to 800 $g/m^2$, and preferably 150 to 500 $g/m^2$. The thickness of the base fabric is not particularly limited, but can usually be 0.4 to 1.3 mm, and preferably 0.6 to 1.1 mm. The density of the base fabric is not particularly limited, but can usually be 0.25 to 0.55 $g/cm^3$, and preferably 0.35 to 0.45 $g/cm^3$.

The base fabrics other than the base fabrics having a joint portion of the papermaking felt according to the present invention are not particularly limited, but any of a seam base fabric, a plain weave suture base fabric, a hollow weave base fabric, a spiral base fabric, and a non-woven base fabric may be used. Of these, endless base fabrics such as hollow weaves and spiral base fabrics are preferred from the viewpoint of smoothness and the like.

Preferred embodiments of the endless base fabric include the above-mentioned constituting materials, shapes, fineness of the MD and CD yarn materials and the base fabric basis weight.

With regard to all the base fabrics used in the papermaking felt according to the present invention, the dimensions of the base fabric are not particularly limited as long as the dimensions of the final product (papermaking felt) can be met by overlapping base fabrics comprising a combination of 2 or more plain weave base fabrics joined together in the MD direction end portions and directly overlapping each other.

The present invention relates to a method for producing a papermaking felt, which comprises (a) a step for overlapping each base fabric, which comprise a combination in which 2 or more base fabrics are directly overlapped with each other, which are made from an MD yarn material in the felt running direction (MD direction) and a CD yarn material of the felt cross-direction (CD direction), and which have a joint portion in which the MD direction end portions comprising a 1st MD direction end portion and a 2nd MD direction end portion are joined, (b) with regard to the base fabrics having all included joint portions, a step for arranging the base fabrics so as to satisfy the equations (1), (2), hereinafter, when the maximum distance in the MD direction between the joint portions of the base fabrics is x (cm) and the minimum distance thereof is y (cm).

$$x \leq 750 \quad (1)$$

$$10 \leq y \quad (2)$$

(c) a step for integrating the base fabric and a batt fiber layer overlapped in the step (b).

It is preferred that the method for producing a papermaking felt according to the present invention comprises a step (b) for overlapping the base fabrics so that x satisfies the equation (3) hereinafter.

$$x \leq 500 \quad (3)$$

It is preferred that the method for producing a papermaking felt according to the present invention comprises a step (b) for overlapping the base fabrics so that y satisfies the equation (4) hereinafter.

$$51 \leq y \quad (4)$$

EXAMPLES

Hereinafter, the papermaking felt according to the present invention will be described in detail with reference to the examples, but these examples do not limit the invention in any way.

The papermaking felts of Examples 1 to 4 and Comparative Examples 1 and 2 were prepared by using base fabrics having the joint portions shown hereinafter. The end portions in the MD direction were joined by ultrasonic welding, and 2 base fabrics having joint portions were overlapped. After attaching a batt fiber layer to the 2 joint portions, a predetermined tension was applied to make the lengths of the base fabrics equal.

Table 1 shows the distance in the MD direction between the joint portions of the base fabrics, the presence or absence of opening of the joint portions after the batt fiber layer is attached, whether the length of the base fabric can be adjusted, and the overall value (OA value) of the vibration test.

Base fabric dimensions: length (MD direction) 1550 cm×width (CD direction) 500 cm

TABLE 1

| | Distance between the joint portions in the MD direction (cm) | Opening of joint portion: Wet paper web-side base fabric | Opening of joint portion: Papermaking machine side base fabric | Adjustment of the base fabric length | Vibrations (OA value) |
|---|---|---|---|---|---|
| Comparative Example 1 | 775 | Opening | Opening | Not possible | 0.2 |
| Example 1 | 750 | No opening | No opening | Possible | 0.2 |
| Example 2 | 500 | No opening | No opening | Possible | 0.2 |
| Example 3 | 51 | No opening | No opening | Possible | 0.2 |
| Example 4 | 10 | No opening | No opening | Possible | 0.4 |
| Comparative Example 2 | 8 | Opening | Opening | Possible | 0.4 |

Furthermore, the papermaking felts of Examples 5 to 10 and Comparative Examples 3 and 4 were prepared by using the base fabrics having joint portions shown hereinafter. The end portions in the MD direction were joined by ultrasonic welding, and 3 base fabrics having joint portions were overlapped. After attaching a batt fiber layer to the 3 joint portions, a predetermined tension was applied to make the lengths of the base fabrics equal. Of the 3 joint portions, the joint portions were designated as joint portion 1, joint portion 2, and joint portion 3 from the running direction side.

Table 2 shows the distance in the MD direction between the joint portions of the base fabrics, the presence or absence of opening of the joint portions after the batt fiber layer is attached, whether the length of the base fabric can be adjusted, and the overall value (OA value) of the vibration test.

Base fabric dimensions: length (MD direction) 1550 cm×width (CD direction) 500 cm

TABLE 2

| | Distance between the joint portions in the MD direction (cm): Between joint portion 1 and 2 | Between joint portion 2 and 3 | Between joint portion 1 and 3 | Opening of joint portion: Wet paper web-side base fabric | Papermaking machine-side base fabric | Adjustment of the base fabric length | Vibrations (OA value) |
|---|---|---|---|---|---|---|---|
| Comparative Example 3 | 375 | 400 | 775 | Opening | Opening | Not possible | 0.2 |
| Example 5 | 375 | 375 | 750 | No opening | No opening | Possible | 0.4 |
| Example 6 | 300 | 450 | 750 | No opening | No opening | Possible | 0.2 |
| Example 7 | 51 | 449 | 500 | No opening | No opening | Possible | 0.2 |
| Example 8 | 51 | 80 | 131 | No opening | No opening | Possible | 0.2 |

TABLE 2-continued

| | Distance between the joint portions in the MD direction (cm) | | | Opening of joint portion | | | |
|---|---|---|---|---|---|---|---|
| | Between joint portion 1 and 2 | Between joint portion 2 and 3 | Between joint portion 1 and 3 | Wet paper web-side base fabric | Papermaking machine-side base fabric | Adjustment of the base fabric length | Vibrations (OA value) |
| Example 9 | 10 | 51 | 61 | No opening | No opening | Possible | 0.4 |
| Example 10 | 10 | 10 | 20 | No opening | No opening | Possible | 0.6 |
| Comparative Example 4 | 5 | 8 | 13 | Opening | Opening | Possible | 0.4 |

Moreover, the papermaking felts of Examples 11 to 14 and Comparative Examples 5, 6 were prepared by using the endless base fabrics and the base fabrics having joint portions shown hereinafter. The end portions in the MD direction of the base fabrics having a joint portion were joined by ultrasonic welding, 2 base fabrics were directly overlapped, and 1 hollow weave base fabric was overlapped as wet paper web-side base fabric. After attaching a batt fiber layer to the 2 joint portions, a predetermined tension was applied to make the lengths of the base fabrics equal.

Table 1 shows the distance in the MD direction between the joint portions of the base fabrics, the presence or absence of opening of the joint portions after the batt fiber layer is attached, whether the length of the base fabric can be adjusted, and the overall value (OA value) of the vibration test.

Base fabric dimensions: length (MD direction) 1550 cm×width (CD direction) 500 cm

TABLE 3

| | Distance between the joint portions in the MD direction (cm) | Opening of joint portion | | Adjustment of the base fabric length | Vibrations (OA value) |
|---|---|---|---|---|---|
| | | Wet paper web-side base fabric | Papermaking machine side base fabric | | |
| Comparative Example 5 | 775 | Opening | Opening | Not possible | 0.1 |
| Example 11 | 750 | No opening | No opening | Possible | 0.1 |
| Example 12 | 500 | No opening | No opening | Possible | 0.1 |
| Example 13 | 51 | No opening | No opening | Possible | 0.1 |
| Example 14 | 10 | No opening | No opening | Possible | 0.3 |
| Comparative Example 6 | 8 | Opening | Opening | Possible | 0.3 |

In Tables, 1, 2, 3, whether or not the joint portions open and whether or not it is possible to adjust the length of the base fabrics is evaluated as manufacturability. After the batt fiber layer was attached, it was confirmed, as the evaluation, by visual observation whether or not the joint portion had opened by removing the batt fiber layer from the joint portion rear-surface of the wet paper web-side base fabric and the joint portion surface of the papermaking machine-side base fabric.

Whether or not the length of a base fabric can be adjusted was confirmed by visual observation of whether any of the base fabrics was longer (whether there were wrinkles or the like) when a tension of 3 kN/m was applied after the batt fiber layer had been attached to 2 or 3 joint portions and when one round of batt fiber layer had been attached.

The running stability was evaluated by the vibrations. The vibrations were evaluated by measuring the acceleration (overall value) in the pressurizing direction of an FFT analysis at a speed of 1000 m/min and a pressurization of 100 kg/cm. In general, when this value is less than 0.3, it can be said that the vibrations are good.

As is clear from the Tables, when the maximum distance in the MD direction of the joint portion of the base fabric having a joint portion was set to 750 cm or less and the minimum distance was set to 10 cm or more, neither the wet paper-side base fabric nor the papermaking machine-side base fabric opened. In the length adjustment of the base fabrics, it was possible to make the length of each base fabric equal when the maximum distance between the joint portions in the MD direction was 750 cm or less. It was understood that vibrations did not occur and the running stability was good when the minimum distance between the joint portions in the MD direction was 51 cm or more and the distances between the joint portions in the MD direction were not equal to each other when there were 3 base fabrics having a joint portion.

EXPLANATION OF THE REFERENCES

B Base fabric

B' Wet paper web-side base fabric (base fabric having a joint portion)

B" Papermaking machine-side base fabric (base fabric having a joint portion)

B'" Base fabric between the wet paper web-side base fabric and the papermaking machine-side base fabric (base fabric having a joint portion)

B"" Wet paper web-side base fabric (hollow weave base fabric)

1 $1^{st}$ MD direction end portion region

2 $2^{nd}$ MD direction end portion region

3 Joint portion of the wet paper web-side base fabric

4 Joint portion of the papermaking machine-side base fabric

5 Distance in the MD direction between the joint portions

6 Joint portion of the base fabric between the wet paper web-side base fabric and the papermaking machine-side base fabric

7 Maximum distance in the MD direction between the joint portions

8 Minimum distance in the MD direction between the joint portions

The invention claimed is:

1. A papermaking felt made from an MD yarn material in the felt running direction (MD direction) and a CD yarn material in the felt cross-direction (CD direction), with the length in the MD direction being 1550 cm or more and 40000 cm or less, comprising a combination wherein two or more base fabrics are directly overlapped with each other, which have a joint portion wherein MD direction end portions are joined which comprise a first MD direction end portion and a second MD direction end portion wherein, with regard to the base fabrics having all included joint portions, the equations (1) and (2) hereinafter are satisfied when the maximum distance in the MD direction between the joint portions of the base fabrics is x (cm) and the minimum distance thereof is y (cm)

$$x \leq 750 \quad (1)$$

$$51 \leq y \quad (2).$$

2. The papermaking felt according to claim 1, wherein x satisfies the equation (3) hereinafter.

$$x \leq 500 \quad (3)$$

3. The papermaking felt according to claim 1, which comprises two base fabrics having a joint portion.

4. The papermaking felt according to claim 1, which comprises three or more base fabrics having a joint portion, and wherein the distances between the joint portions of the base fabric in the MD direction are not equal to each other.

5. The papermaking felt according to claim 1, which further comprises an endless base fabric.

6. The papermaking felt according to claim 1, wherein the MD-direction end portions of the base fabric having a joint portion are joined by welding.

7. The papermaking felt according to claim 1, which comprises a batt fiber layer of a non-woven fiber material.

8. A method for producing a papermaking felt, which comprises:

(a) a step for overlapping each base fabric, which are made from an MD yarn material in the felt running direction (MD direction) and a CD yarn material in the felt cross-direction (CD direction), with the length in the MD direction being 1550 cm or more and 40000 cm or less, and which comprise a combination wherein two or more base fabrics are directly overlapped with each other, which have a joint portion wherein MD direction end portions comprising a first MD direction end portion and a second MD direction end portion are joined, (b) with regard to the base fabrics having all included joint portions, a step for arranging the base fabrics so as to satisfy the equations (1) and (2), hereinafter, when the maximum distance in the MD direction of the joint portions of the base fabrics is x (cm) and the minimum distance thereof is y (cm), $$x \leq 750 \quad (1)$$

$$51 \leq y \quad (2)$$

(c) a step for integrating the base fabric and a batt fiber layer overlapped in the step (b).

9. The method for producing a papermaking felt according to claim 8, which comprises a step (b) for overlapping the base fabrics so that x satisfies the equation (3) hereinafter.

$$x \leq 500 \quad (3)$$

* * * * *